US006225540B1

(12) United States Patent
Arias Fernandez et al.

(10) Patent No.: US 6,225,540 B1
(45) Date of Patent: May 1, 2001

(54) MULTITIMBRE BAGPIPE

(75) Inventors: Angel Alberto Arias Fernandez; Jose Angel Hevia Velasco; Jose Miguel Dopico Suarez, all of Gijon (ES)

(73) Assignee: Version Midi, S.L., Gijon (ES)

( * ) Notice: Subject to any disclaimer, the term of this patent is extended or adjusted under 35 U.S.C. 154(b) by 0 days.

(21) Appl. No.: 09/485,134

(22) PCT Filed: Jun. 4, 1999

(86) PCT No.: PCT/ES99/00165

§ 371 Date: Mar. 21, 2000

§ 102(e) Date: Mar. 21, 2000

(87) PCT Pub. No.: WO99/65015

PCT Pub. Date: Dec. 16, 1999

(30) Foreign Application Priority Data

Jun. 5, 1998 (ES) ..... 98/01170

(51) Int. Cl.[7] ..... G10D 7/00
(52) U.S. Cl. ..... 84/380 B
(58) Field of Search ..... 84/380 B

(56) References Cited

FOREIGN PATENT DOCUMENTS 2 025 680 1/1980 (GB) .
1 600 284 10/1981 (GB) .

OTHER PUBLICATIONS

"O'Neill's Electronic Bagpipe Page," http://www.california-.com/~oneill/epipe.htm, Jun. 25, 1999.*

"The Techno–Chanter," Anders Fagerstorm, http://member-.austasia.net/~barprint/chanter.htm.*

"Deger Pipes Operating Manual," Manfred Deger, pp. 1–11, Jan. 1999.*

A. Kramer, "Piping Can Electronic Musical Instrument," Dec. 1980, pp. 12.42–12.43,Elektor, vol. 6.*

* cited by examiner

*Primary Examiner*—Jeffrey Donels
(74) *Attorney, Agent, or Firm*—Merchant & Gould P.C.

(57) ABSTRACT

System for multitimber bagpipe which comprises a semi-rigid and ergonomic support of the bellows type (1) which receives on its walls the system components; a flexible tubular structure at the narrow extremity of the support and wherein the pipe (6) is nested, the latter having sensors (6') which can be pressed down according to the note the user wants to obtain; a user interface situated externally to the bellows and provided with an alphanumeric display or viewer (5) and which displays all the possible options of the menu, and buttons (4) which set the user's dialogue with the system; analog or digital internal sensors (2) (2') (2") to detect the pressure exerted by the user's arm onto the bellows (1); and an electronic card (8) controlled by a microprocessor and containing all the necessary information.

5 Claims, 2 Drawing Sheets

MULTITIMBRE BAGPIPE

DESCRIPTION OF THE INVENTION

The present invention relates to a system for multitimbre bagpipe designed to obtain all the possible musical scales by means of electronic devices controlled by an electronic card, being that card controlled by a microprocessor, thus avoiding the continuous inflating of the bellows and thus allowing to play the instrument even to people physically disabled to play wind instruments.

BACKGROUND OF THE INVENTION

Until now, there is only a main type of bagpipe composed of a bellows, a blowpipe, an air outlet device, one or more drones and a pointer pipe, such that the bellows is positioned under the left arm and the drone is positioned over the left shoulder. Playing then starts by air-blowing through the blowpipe so air comes into the bellows and this is inflated; the player then smoothly presses the bellows with his arm and the air starts to get out through the drone, thus producing a husky sound, and through the air outlet device and the pointer pipe holes, thus producing a sound that is modulated by the player by using his fingers, finally producing the different notes of the musical scale and the melody intended to be played. With these current bagpipes, difficulties to play arise for that people that is not familiar with this type of instrument and also for disabled people; moreover, a very accurate play is needed if unclear notes are to be avoided because of a wrong positioning of the fingertips that may result in a defective plugging of the pointer pipe holes.

To prevent these problems the system for multitimbre bagpipe has been created, that substantially improves the performance of the manual bagpipes that are currently known, specially by avoiding the problems related with the different sizes of the air outlet device that make more difficult to play accurately. Moreover, the system for multitimbre bagpipe can be played by persons with finger motility difficulties, as it will be explained, and furthermore prevents the mistuning completely.

DESCRIPTION OF THE INVENTION

The system for multitimbre bagpipe is composed of:

- A semi-rigid, ergonomic, bellows-type support, with a flexible tubular structure at one end, where the pointer pipe is housed.
- A pointer pipe with a series of sensors that the player must press according to the note he wants to be played.
- A user interface, in the outside of the bellows-type support, provided with an alphanumeric display or viewer that shows all the menu possible options; and some press buttons that allow the relation system-user in what refers to programs, volumes and any other variables, and allow as well to select options like the type of bagpipe sound to produce, i.e. Galicia, Ireland, Bretagne, Scotland, etc.
- Some sensors, located on the widest section of the inside wall of the bellows-type support. Said sensors detect the player's arm pressure on the bellows-type support; when this pressure starts, a metal strap located on the inside wall opposite to the sensors wall makes contact with the first sensor, thus producing the drone sound; by increasing the prssure, the metal strap makes contact with the second sensor and the sound comes out from the pointer pipe and produces different musical notes according to the player's fingers position; by progressively increasing the pressure, the metal strap makes contact with the third sensor which allows the obtention of the notes of the second octave. Although a type of digital pressure sensor is being described, other different types of sensors can be used, i.e., analogic pressure sensors such as strain gages, potentiometers, piezoelectric, magnetic, inductive and capacitive sensors, among others present in the marketplace.
- An electronic card, located in the inside wall of the bellows-type support, and controlled by means of a microprocessor; said card is provided with a program memory, an operating system, AID (analogic/digital) converters, digital inputs/outputs, noise suppressor filters and user's memory, among others. The said electronic card, controlled by means of a microprocessor, undertakes the transformation of digitized messages transmitted by the player by pushing the pointer pipe sensors and, according to the previously selected interface option, sends these messages through a digital outlet in midi (musical instruments digital interface) language, that is a universally known system. This so created information is sent via cable to any apparatus able to understand the midi language, such as a computer with all its technical possibilities; a sound board to obtain a high-fidelity sound, etc., being also possible to establish a wireless transmission. The said microprocessor controlled electronic card accepts any change in the digitization of the instrument so different bagpipe sounds (Galicia, Asturias, Bretagne, Ireland, Scotland) as well as any other wind instrument sound can be imitated; non-current digitizations can also be adapted, including systems with a reduced number of sensor combinations, suitable to allow a disabled person to play this type of instrumental music.
- The pointer pipe, the display and the sensors are connected to the electronic card by means of the corresponding cables.
- The bellows-type support is provided with a cloth cover with a zipper in its back side that allows access to the inside parts.

DESCRIPTION OF THE DRAWINGS

For a better understanding of the characteristics of the invention a set of drawings is attached herein, said drawings being disclosed with an explaining and non-limiting purpose.

PREFERRED EMBODIMENT OF THE INVENTION

Figure 2:
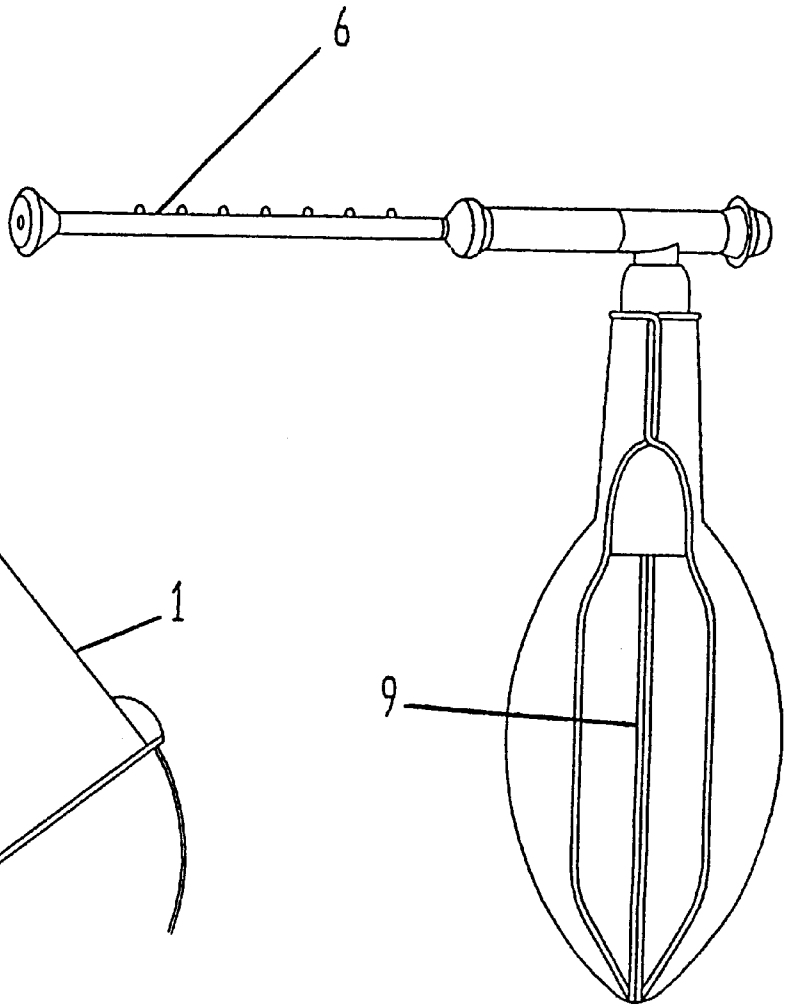
FIG. 2 shows a back view of the system for multitimbre bagpipe.
Figure 1:
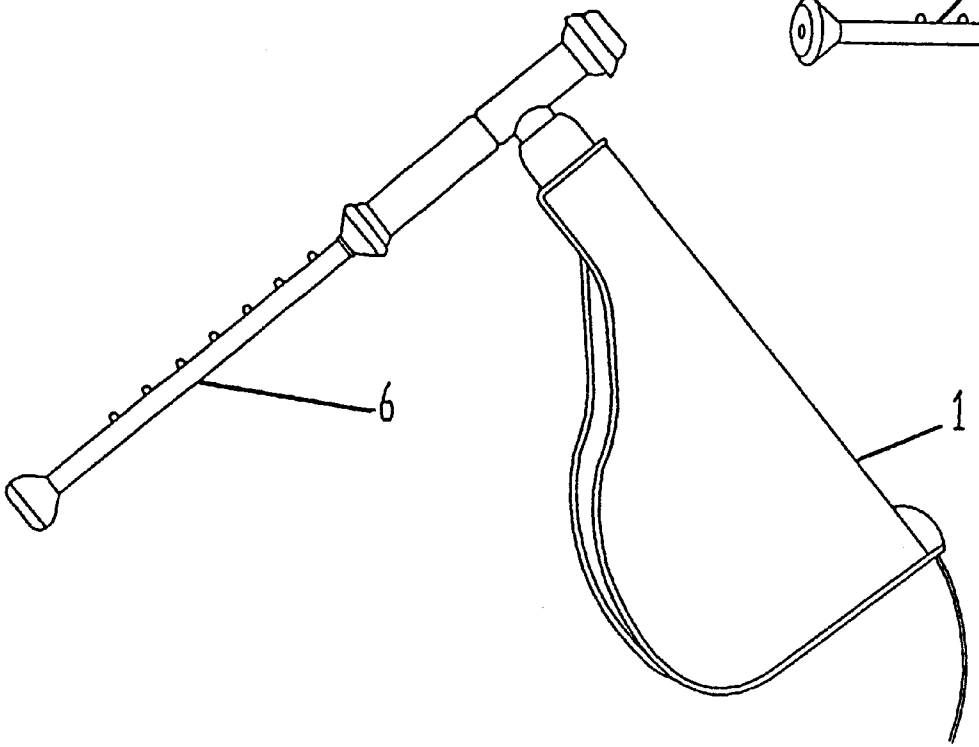
FIG. 1 shows a side view of the system for multitimbre bagpipe.
Figure 3:
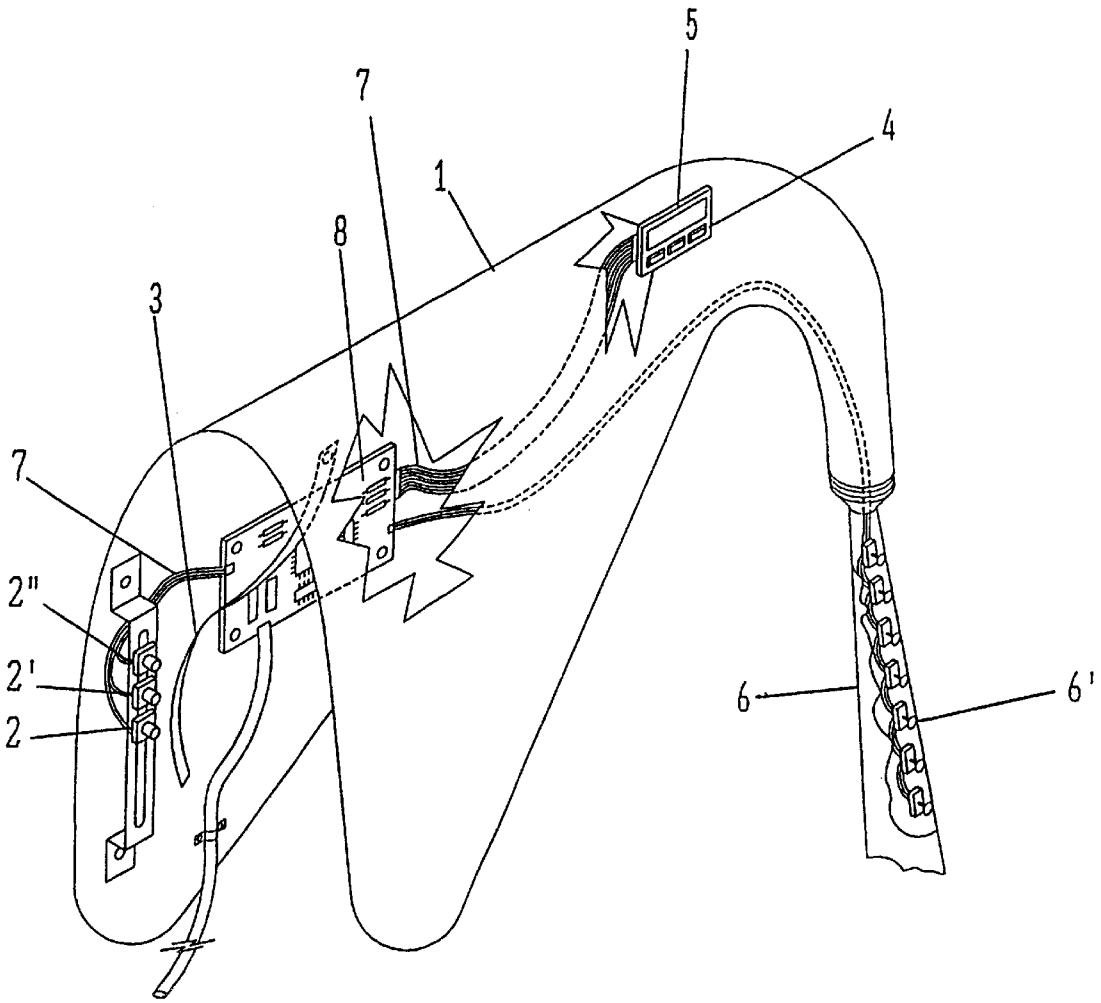
FIG. 3 shows a perspective view of the inside of the system for multitimbre bagpipe.

To operate the system for multitimbre bagpipe of the present invention, it must be connected to the electrical network by means of an electric supplier that assures the suitable voltage (not shown in the figures). Then, by using the appropriate interface push-buttons (4), the desired program (bagpipe type, volume, etc.) is selected, being these characteristics shown in the alphanumeric display (5). The said interface establishes the player-system dialogue in what relates to program, volume and any other type of arrangement that is desired. The player's arm then presses the bellows-type support (1) in such a way that a pressure sensor (2), through the contact with a metal strap (3), detects the pressure applied on the lower part of the bellows-type support (1)(the upper part is rigid), thus the drone sound being produced; if the the arm pressure goes on, the metal strap (3) makes contact with the second sensor (2') thus the pointer pipe (6) sound being produced, said sound being modulated and different notes being produced by means of the different position of the player's fingers on the sensors (6'); if the arm pressure on the bellows-type support is increased, the metal strap (3) makes contact with the sensor (2") thus producing a second octave sound. All that information is conveyed by means of cables (7) to an electronic card (8) controlled by a microprocessor. The said card (8) has a program memory, an operating system, A/D (analogic/digital) converters, digital inputs/outputs, noise suppressor filters and user's memory. The said card (8), undertakes the transformation of digitized messages transmitted by the player by pushing the pointer pipe sensors or push-buttons (6'), as well as the functions previously selected in the display(5) menu through a digital outlet, all the above in compatible midi (musical instruments digital interface) language, that is an already universally known system. This so created information is sent via cable to any apparatus able to understand the midi language, such as a computer, a sound board, etc. The bellows-type support (1) is provided with a cloth cover with a zipper in its back side that allows access to the inside parts.

A more detailed description is not considered necessary in order to allow a skilled person to properly understand the scope and the benefits of the invention. The present description must be understood in a comprehensive and non-limiting way.

Materials, shape, size and assembly of the elements may be modified as far as the essential features of the invention, as claimed below, are maintained.

What is claimed is:

1. A multitimbre bagpipe comprising:

a semi-rigid, ergonomic, bellows-type support;

a flexible tubular structure disposed at a first end of said support;

a pointer pipe disposed on said flexible tubular structure;

first pressure sensors disposed on said pointer pipe, said first sensors being adapted to detect pressure applied to said pointer pipe;

an electronic card in communication with said first pressure sensors; and sound output means, said sound output means being in communication with said electronic card; and a user interface adapted to adjust said electronic card;

wherein said electronic card is adapted to control a timbre of sounds output from said sound output means, and wherein adjusting said electronic card with said user interface adjusts the timbre of sounds output from said sound output means.

2. A multitimbre bagpipe according to claim 1, wherein the first pressure sensors disposed on the pointer pipe include at least one selected from the group consisting of electromecanical, optical, magnetic, capacitive and inductive sensors.

3. A multitimbre bagpipe according to claim 1, wherein the first pressure sensors include at least one selected from the group of analog sensors and digital sensors.

4. A multitimbre bagpipe according to claim 1, wherein the user interface comprises an alphanumeric display, and push-buttons adapted to adjust said electronic card.

5. A multitimbre bagpipe according to claim 1, further comprising second pressure sensors disposed within said support, said second sensors being adapted to detect pressure applied to said support, wherein said electronic card is in communication with said second pressure sensors.

* * * * *